US006122777A

United States Patent [19]

Sage-Passant

[11] Patent Number: 6,122,777

[45] Date of Patent: Sep. 26, 2000

[54] APPARATUS FOR COUPLING FLUID FLOW LINES

[76] Inventor: Peter Sage-Passant, c/o Mechline Development Ltd., Unit 18 Potters Lane, Kiln Farm, Milton Keynes, MK11 3NF, United Kingdom

[21] Appl. No.: 09/191,010

[22] Filed: Nov. 12, 1998

Related U.S. Application Data

[60] Provisional application No. 60/066,332, Nov. 21, 1997.

[30] Foreign Application Priority Data

Nov. 15, 1997 [GB] United Kingdom ..... 9724089

[51] Int. Cl.[7] ..... E03C 1/042

[52] U.S. Cl. ..... 4/695; 285/33

[58] Field of Search ..... 4/695, 696, 619; 285/33, 137.1, 921; 137/360, 361, 899

[56] References Cited

U.S. PATENT DOCUMENTS

| | | | |
|---|---|---|---|
| 1,825,033 | 9/1931 | Walker | 4/638 X |
| 2,287,657 | 6/1942 | Wisckol | 4/653 X |
| 3,170,667 | 2/1965 | Szohatzky | 137/360 X |
| 3,623,166 | 11/1971 | Wilkinson | 4/191 |
| 4,371,995 | 2/1983 | Donhauser | 4/546 X |
| 4,420,006 | 12/1983 | Moore et al. | 134/115 R X |
| 4,716,925 | 1/1988 | Prather | 137/360 |
| 4,935,971 | 6/1990 | Dunn et al. | 4/546 X |
| 5,029,606 | 7/1991 | Kuhlthau, Jr. | 137/360 |
| 5,205,002 | 4/1993 | Sage-Passant . | |

FOREIGN PATENT DOCUMENTS

| | | | |
|---|---|---|---|
| 1457600 | 8/1959 | Germany | 4/643 |
| 1 459 600 | 8/1969 | Germany . | |
| 2 063 622 | 7/1971 | Germany . | |
| 2063622 | 7/1971 | Germany | 4/191 |
| 0226941 | 9/1989 | Japan | 4/191 |
| 1-226941 | 9/1989 | Japan . | |
| 1 330 403 | 9/1973 | United Kingdom . | |
| 2 243 422 | 10/1991 | United Kingdom . | |

*Primary Examiner*—Charles E. Phillips
*Attorney, Agent, or Firm*—Merchant & Gould P.C.

[57] ABSTRACT

An apparatus for coupling fluid flow lines to a mobile sink unit or appliance. The apparatus includes a first part (2) for mounting on the mobile sink unit or appliance and a second part (4) for mounting on a wall. The first and second parts being separable by relative movement in a first direction that is substantially horizontal. The first part (2) including a plurality of first connector elements (6) mounted on a first support member (10). Each first connector element (6) has a longitudinal axis that is substantially vertical. The first support member (10) is mounted for vertical reciprocating movement. The second part (4) includes a plurality of second connector elements (20) mounted on a second support member (22), each second connector element (20) having a longitudinal axis that is substantially vertical. Each second connector element (20) is connectable to one of the first connector elements (6) to make a fluid flow connection by axial movement relative thereto. A drive member (44) for engaging the first support member (10) when the first connector elements (6) are axially aligned with the second connector elements (20). An operating handle (30) that is drivingly connected to the drive member (44), and is operable to drive the drive member (44) in the direction of said longitudinal axes, to connect or disconnect said first and second connector elements.

8 Claims, 4 Drawing Sheets

APPARATUS FOR COUPLING FLUID FLOW LINES

This application claims the benefit of U.S. Provisional Application No. 60/066,332 filed on Nov. 21, 1997.

The present invention relates to an apparatus for coupling fluid flow lines to a mobile sink unit or appliance. More particularly, but not exclusively, the invention concerns an apparatus for connecting water supply lines to a sink unit or a unit of catering or washing equipment. The present invention also relates to a mobile sink unit having a coupling apparatus for coupling fluid flow lines thereto.

Commercial catering establishments are subject to stringent health and hygiene requirements. Ease of access for cleaning purposes is a major consideration in the design of kitchens and catering equipment. It is increasingly common for such equipment to be mobile, thereby allowing staff full access to clean both the equipment itself and the underlying floor area. In the case of equipment such as sink units and dishwashers that have to be connected to a fresh water supply, it is desirable that the fluid flow lines should be readily disconnected when cleaning is required.

An apparatus for coupling fluid flow lines to a mobile unit of catering equipment is described in the applicant's earlier British patent No. 2243422. That apparatus includes a wall-mounted connection unit supporting a plurality of base connector elements that extend away from the wall. Those base connector elements may be coupled to satellite connector elements on the mobile unit simply by aligning the connectors and pushing the mobile unit towards the wall so that the connectors latch together with a horizontal coupling action. An operating handle provided on the mobile unit allows the connectors to be unlatched and separated.

The apparatus described above has a number of disadvantages, some of which are as follows. The apparatus is relatively expensive and attaching it to a sink unit generally requires a rather expensive fabrication process. It is also quite large, occupying a large space at the back of the sink. Further, it has been found that the horizontal coupling action places a large stress on the wall and relatively weak walls such as partition walls therefore have to be strengthened when the apparatus is fitted.

Another device for operatively connecting fluid ducts to a portable utility unit is described in U.S. Pat. No. 3,623,166 in the name of Wilkinson. In that device, a water coupling connection is effected by driving projecting coupling nipples into engagement with sealing washers in respective coupling sockets. An operating handle is provided to effect the connection. The device is mounted in the floor and a vertical coupling action is employed, the axes of the coupling nipples being vertical and the two halves of the device being separable in the direction of those axes.

It is an object of the present invention to provide an apparatus for coupling fluid flow lines to a mobile sink unit or appliance that mitigates at least some of the aforesaid disadvantages.

According to the present invention there is provided an apparatus for coupling fluid flow lines to a mobile sink unit or appliance, the apparatus including a first part for mounting on the mobile sink unit or appliance and a second part for mounting on a wall, said first and second parts being separable by relative movement in a first direction that is substantially horizontal in use, said first part including a plurality of first connector elements mounted on a first support member, each first connector element having a longitudinal axis that is substantially perpendicular to said first direction and substantially vertical in use, said first support member being mounted for reciprocating movement in the direction of said longitudinal axes, said second part including a plurality of second connector elements mounted on a second support member, each second connector element having a longitudinal axis that is substantially perpendicular to said first direction and substantially vertical in use, each said second connector element being connectable to one of the first connector elements to make a fluid flow connection by axial movement relative thereto, a drive member for engaging the first support member when said first connector elements are axially aligned with said second connector elements, and an operating handle that is drivingly connected to said drive member, said operating handle being operable to drive said drive member in the direction of said longitudinal axes, to connect or disconnect said first and second connector elements.

The apparatus allows a mobile sink unit or other appliance (such as a dishwasher or washing machine, for example) to be connected to and disconnected from a fresh water supply very easily, so allowing the unit to be moved for cleaning purposes. The first part of the apparatus may be attached easily to a standard sink unit without the need for special fabrication and the second part may be attached to a wall, usually without any need for reinforcement. The apparatus is relatively inexpensive and simple to operate.

Advantageously said second part includes a plate member for mounting the second part on a wall.

The drive member may be separable from said first support member by relative movement in said first direction.

Advantageously, the first connector elements are male connector elements and said second connector elements are female connector elements.

The first support member may be biassed towards a position in which the first and second connector elements are disconnected. The apparatus may include guide means for axially aligning said first and second connector elements. These features help to simplify the process of connecting and disconnecting the two connector elements.

Advantageously, each said second connector element includes a latching device for releasably latching said second connector element to one of said first connector elements, said operating handle being drivingly connected to said latching devices and operable to release said latching devices. Preferably, the first and second connector elements comprise double shut-off couplings.

According to a further aspect of the present invention there is provided a mobile sink unit having a coupling apparatus for coupling fluid flow lines thereto, the coupling apparatus including a plurality of connector elements mounted on a support member with their longitudinal axes substantially vertical, each said connector element being connected to a tap or faucet of the sink unit by means of a flexible connector and being suitable for separable connection to a complementary connector element through movement relative thereto in the direction of said longitudinal axis, said first support member being mounted for reciprocating movement in the direction of said longitudinal axes.

Embodiments of the present invention will now be described, by way of example, with reference to the accompanying drawings, of which:

Figure 4:
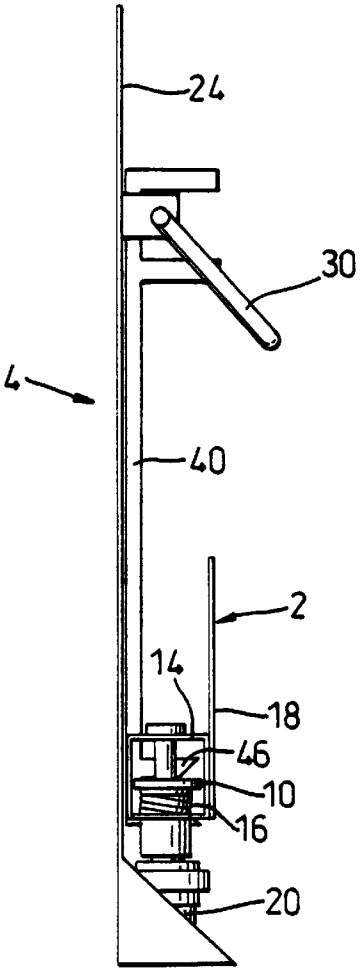
Figure 5:
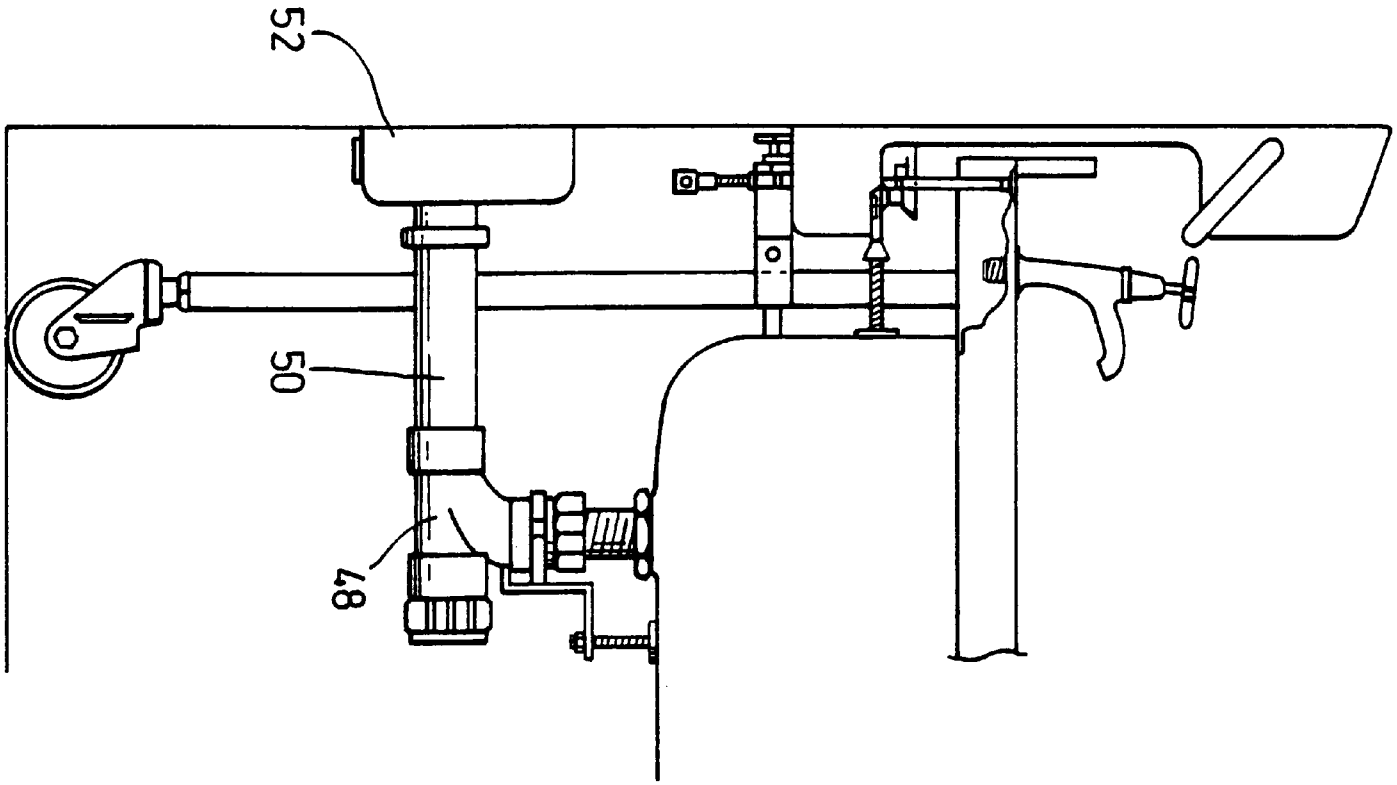

FIG. 4 a side view showing the two parts of the apparatus engaged and coupled;

FIG. 5 is a side view of a drain connector, and

Figure 6:
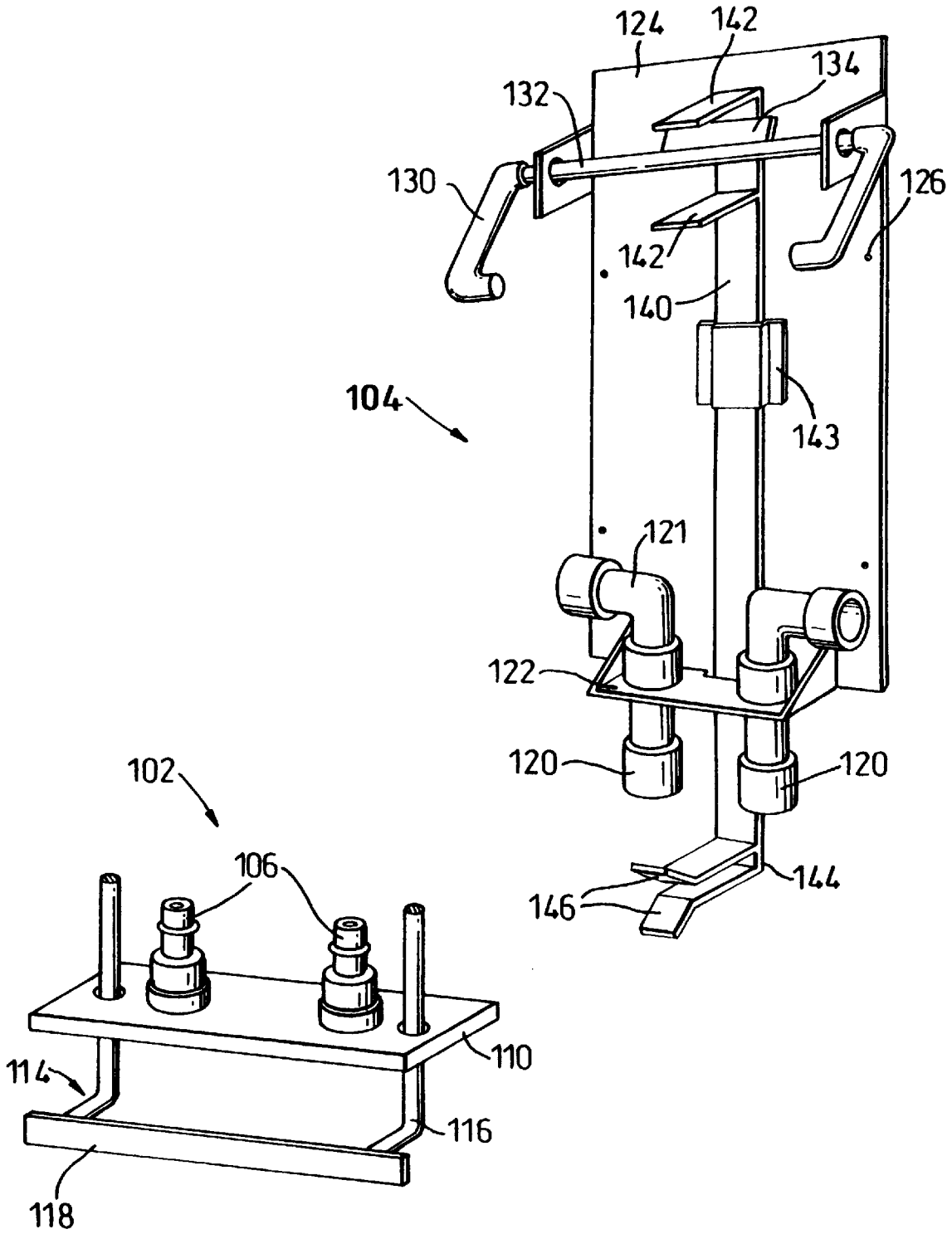

FIG. 6 is a perspective view of a second embodiment showing both parts of the apparatus.

The apparatus includes a first part 2 that is mounted in use on a mobile sink unit (or some other catering or washing appliance) and a second part 4 that is designed to be mounted on a wall.

The first part 2 includes a pair of male connectors 6 that are connected by means of flexible hoses 8 to the taps or faucets of the sink. The male connectors 6 are mounted pointing downwards on a first support plate 10 with their longitudinal axes substantially vertical. The first support plate 10 is mounted by means of slide rods 12 on a frame 14 such that it can reciprocate vertically relative to the frame 14. Compression springs 16 are mounted on the slide rods 12 and are compressed between the lower face of the first support plate 10 and a lower part of the frame 14, so that they resiliently urge the plate upwards. The frame 14 is attached to a mounting plate 18 that is designed to be attached easily to the rear of a standard sink unit, for example using bolts (not shown).

The second part 4 includes a pair of female connectors 20 that are connected by means of flexible hoses or rigid pipework (not shown) to hot and cold water supply ducts. The female connectors 20 are mounted on a second support plate 22 in the lower part of a rigid metal box 24 that is designed to be mounted on a wall, for example with screws (not shown). The female connectors 20 are mounted substantially vertically with their open ends facing upwards. The male and female connectors 6,20 comprise standard self-sealing double shut off couplings and will not be described in detail herein.

Each female connector 20 includes a latching device (not shown in detail) for releasably latching the female connector to one of the male connectors 6. The latching device is operated by means of a sleeve 26 provided on the exterior of the connector 20 and may be released by pressing the sleeve 26 downwards. The sleeves 26 are connected to a link plate 28 so that they may be operated in unison.

At the upper end of the metal box 24 there is provided an operating handle 30 that is connected to a shaft 32 having three radially extending cams 34,36. The central cam 34 engages the upper end of a central drive bar 38 that is connected to the link plate 28 for operating the sleeves 26. It should be noted that the central cam 34, the central drive bar 38, the link plate 28 and the sleeves 26 have been omitted from FIGS. 2 to 4 for the sake of clarity.

Figure 1:
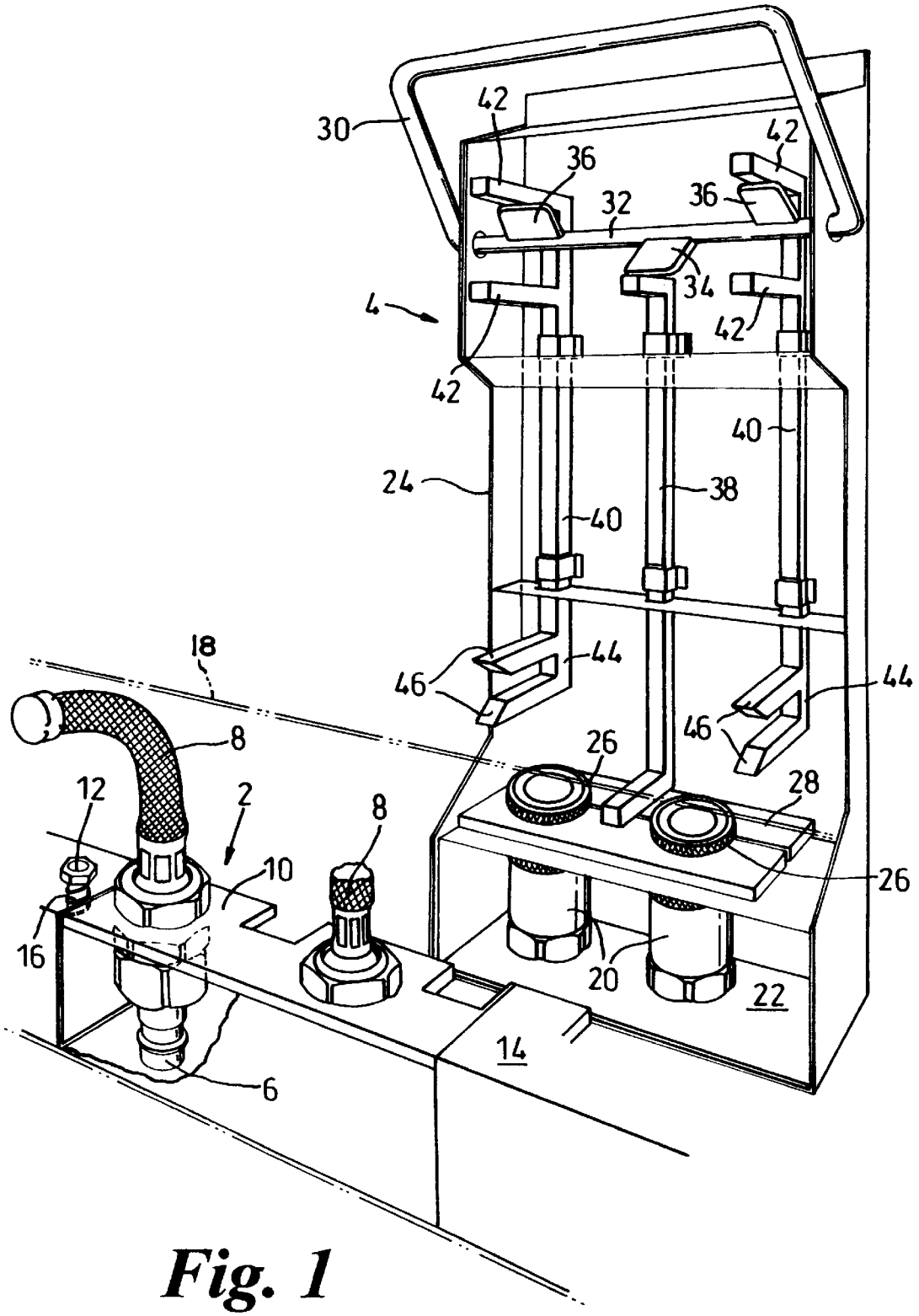
FIG. 1 is a perspective view of a first embodiment showing both parts of the apparatus.
Figure 3:
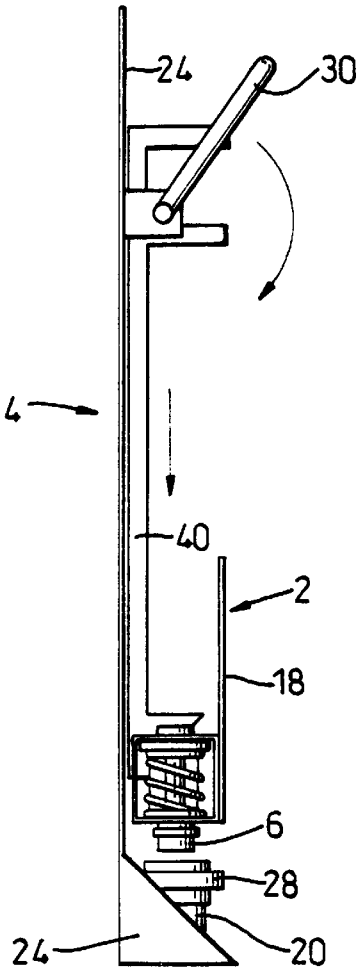
FIG. 3 is a side view showing the two parts of the apparatus engaged but not coupled to one another.
Figure 2:
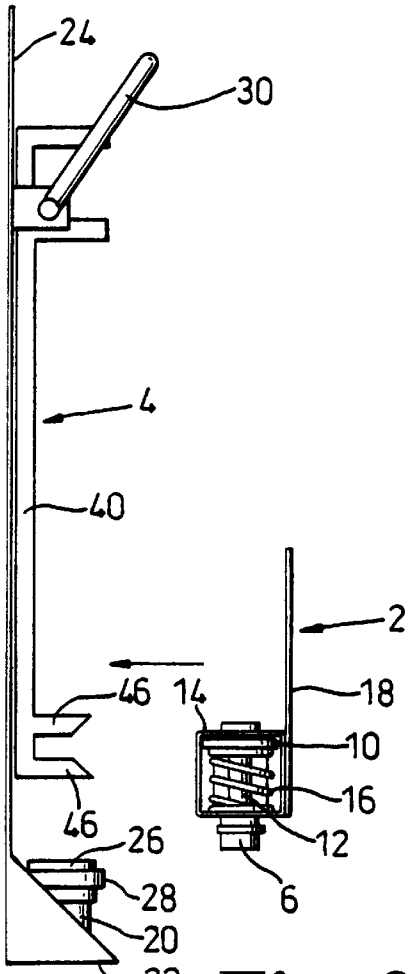
FIG. 2 is a side view showing the two parts of the apparatus disengaged from one another.

When the operating handle 30 is in the raised position as shown in FIGS. 1 to 3, the central cam 34 extends downwards at an angle of approximately 45° below the horizontal. Rotating the handle 30 downwards through an angle of approximately 90° initially drives the link plate 28 downwards, thereby releasing the latching devices in the female connectors 20, and then allows the link plate 28 to return to its original position in which the latching devices are latched.

The two outer cams 36 are identical to one another and are attached to the shaft 32 such that they extend upwards at an angle of approximately 45° above the horizontal when the operating handle 30 is in the raised position. Each cam 36 is connected to a vertical drive bar 40 by means of a pair of horizontal bars 42 that are located above and below the shaft 32.

At the lower end of each drive bar 40 there is provided a drive member 44 comprising another pair of horizontal bars 46 that extend forwards from the vertical drive bar 40. The free ends of the bars 46 are bevelled away from one another. The drive members 44 are arranged to engage the support plate 10 of said first part 2 when the male connectors 6 are aligned with the female connectors 20, as shown in FIG. 3.

When the operating handle 30 is in the raised position as shown in FIG. 2, the drive members 44 are raised by the outer cam elements 36, so that the gap between the horizontal bars 46 is at the same height as the support plate 10. The support plate 10 may thus be brought into engagement with the drive members 44 by pushing the sink unit together with the first part 2 horizontally towards the second part 4, as shown in FIG. 3.

Rotating the handle 30 downwards through an angle of approximately 90° drives the support plate 10 downwards, thereby coupling the male and female connectors 6,20 to one another, as shown in FIG. 4. At the same time, the link plate 28 is pressed downwards and then released, temporarily releasing the latching devices before latching the male and female connectors 6,20 together.

When the handle 30 is returned to the raised position, the latching devices are released by the action of the central cam 34 and the support plate 10 is simultaneously driven upwards, disconnecting the male and female connectors 6,20 from one another. A small amount of lost motion is provided between the handle 30 and the first support plate 10, to ensure that the latching devices are completely released before the support plate 10 starts moving upwards. Once the connectors have been disconnected, the first part 2 and the second part 4 may be separated from one another simply by pulling the sink unit away from the wall.

The apparatus may optionally include a guide mechanism to assist with the correct alignment of the connectors as they are connected together. This guide mechanism may take the form of a pair of bevelled guide members (not shown) provided on either side of the wall-mounted box 24, which engage the sides of the frame 14 and guide it into the correct position as the sink unit is pushed towards the wall.

The apparatus described above does not include a drain connector for waste water as in most situations where it is used the waste conduit of the sink unit will empty directly into a drainage gully provided in the floor. However, the apparatus may optionally include a drain connector, for example of the type described in the inventor's earlier British patent No. 2243422, or of the type shown in FIG. 5. The drain connector shown in FIG. 5 includes a drain tee 48 attached to the mobile sink unit. Attached to the outlet of the drain tee 48 is a length of taper pipe 50. A drain receiver 52, attached to the wall, is positioned such that it is directly in line with the taper pipe 50. The taper pipe 50 connects and disconnects easily with the receiver 52 as the mobile sink unit is connected or disconnected from the wall mounted second part 4.

According to the second embodiment shown in FIG. 6, the apparatus includes a first part 102 that is mounted in use on a mobile sink unit (or some other catering or washing appliance) and a second part 104 that is designed to be mounted on a wall.

The first part 102 includes a pair of male connectors 106 that are connected by means of flexible hoses (not shown) to the taps or faucets of the sink. The male connectors 106 are mounted pointing upwards on a first support plate 110 with their longitudinal axes substantially vertical. The first support plate 110 is mounted on a frame 114, which includes two slide rods 116 and a stay bar 118, such that it can reciprocate vertically relative to the frame. The frame 114 is attached to the rear of a standard sink unit, for example using bolts (not shown).

The second part 104 includes a pair of female connectors 120 that are connected by means of flexible hoses or rigid pipework 121 to hot and cold water supply ducts. The female connectors 120 are mounted on a second support plate 122 at the base of a rigid metal sheet 124 that is designed to be mounted on a wall, for example with screws 126. The female connectors 120 are mounted substantially vertically with their open ends facing downwards. The male and female connectors 106,120 comprise standard self-sealing double shut off couplings.

At the upper end of the metal sheet 124 there is provided an operating handle 130 that is connected to a shaft 132 having a radially extending central cam 134. The central cam 134 is attached to the shaft 132 such that it extends backwards at an angle of approximately 180° from that of the operating handle 130. The central cam 134 is connected to a vertical drive bar 140 by means of a pair of horizontal bars 142 that are located above and below the shaft 132. The vertical drive bar 140 is connected to the metal sheet by means of a bracket 143.

At the lower end of the drive bar 140 there is provided a drive member 144 comprising another pair of horizontal bars 146 that extend forwards from the vertical drive bar 140. The free ends of the bars 146 are angled away from one another. The drive member 144 is arranged to engage the support plate 110 of said first part 102 when the male connectors 106 are aligned with the female connectors 120.

When the operating handle 130 is in the raised position, the drive member 144 is positioned by the cam element 134, so that the gap between the horizontal bars 146 is at the same height as the support plate 10. The support plate 10 may thus be brought into engagement with the drive member 144 by pushing the sink unit together with the first part 102 horizontally towards the second part 104.

Rotating the handle 130 downwards through an angle of approximately 180° drives the support plate 110 upwards, thereby coupling the male and female connectors 106,120 to one another. The handle 130 may be latched by rotating it to an over-centre position, to prevent unintentional uncoupling of the male and female connectors 106,120.

When the handle 130 is returned to the raised position, the support plate 110 is simultaneously driven downwards, disconnecting the male and female connectors 106,120 from one another. Once the connectors have been disconnected, the first part 102 and the second part 104 may be separated from one another simply by pulling the sink unit away from the wall.

The apparatus may optionally include a guide mechanism to assist with the correct alignment of the connectors as they are connected together. This guide mechanism may take the form of a pair of bevelled guide members (not shown) provided on either side of the wall-mounted sheet 124, which engage the sides of the frame 114 and guide it into the correct position as the sink unit is pushed towards the wall.

I claim:

1. An apparatus for coupling fluid flow lines to a mobile sink unit or appliance, the apparatus including a first part for mounting on the mobile sink unit or appliance and a second part for mounting on a wall, said first and second parts being separable by relative movement in a first direction that is substantially horizontal in use, said first part including:

a plurality of first connector elements mounted on a first support member, each first connector element having a longitudinal axis that is substantially perpendicular to said first direction and substantially vertical in use, said first support member being mounted for reciprocating movement in the direction of said longitudinal axes, said second part including:

a plurality of second connector elements mounted on a second support member, each second connector element having a longitudinal axis that is substantially perpendicular to said first direction and substantially vertical in use, each said second connector elements being connectable to one of the first connector elements to make a fluid flow connection by axial movement relative thereto, a drive member for engaging the first support member when said first connector elements are axially aligned with said second connector elements, and an operating handle that is drivingly connected to said drive member, said operating handle being operable to drive said drive member in the direction of said longitudinal axes, to connect or disconnect said first and second connector elements.

2. An apparatus according to claim 1, wherein said second part includes a plate member for mounting the second part on a wall.

3. An apparatus according to claim 1, wherein said drive member is separable from said first support member by relative movement in said first direction.

4. An apparatus according to claim 1, wherein the first connector elements are male connector elements and said second connector elements are female connector elements.

5. An apparatus according to claim 1, wherein the first support member is biassed towards a position in which the first and second connector elements are disconnected.

6. An apparatus according to claim 1, including guide means for axially aligning said first and second connector elements.

7. An apparatus according to claim 1, wherein each said second connector element includes a latching device for releasably latching said second connector element to one of said first connector elements, said operating handle being drivingly connected to said latching devices and operable to release said latching devices.

8. An apparatus according to claim 1, wherein the first and second connector elements comprise double shut-off couplings.

* * * * *